US010858138B2

(12) United States Patent
Joshi et al.

(10) Patent No.: US 10,858,138 B2
(45) Date of Patent: Dec. 8, 2020

(54) CARBONATED BEVERAGE BOTTLE BASES AND METHODS OF MAKING THE SAME

(71) Applicant: THE COCA-COLA COMPANY, Atlanta, GA (US)

(72) Inventors: Rohit Joshi, Alpharetta, GA (US); Ravi D. Mody, Johns Creek, GA (US); David Wheelwright, West Yorkshire (GB); Roger Kerr, Sugar Land, TX (US)

(73) Assignee: THE COCA-COLA COMPANY, Atlanta, GA (US)

( * ) Notice: Subject to any disclaimer, the term of this patent is extended or adjusted under 35 U.S.C. 154(b) by 324 days.

(21) Appl. No.: 15/536,930

(22) PCT Filed: Dec. 16, 2015

(86) PCT No.: PCT/US2015/066049
§ 371 (c)(1),
(2) Date: Jun. 16, 2017

(87) PCT Pub. No.: WO2016/100483
PCT Pub. Date: Jun. 23, 2016

(65) Prior Publication Data

US 2018/0044050 A1 Feb. 15, 2018

Related U.S. Application Data

(60) Provisional application No. 62/094,450, filed on Dec. 19, 2014.

(51) Int. Cl.

| | |
|---|---|
| ***B65D 1/02*** | (2006.01) |
| ***B65B 3/02*** | (2006.01) |
| ***B65D 85/72*** | (2006.01) |

(52) U.S. Cl.
CPC ..... *B65D 1/0284* (2013.01); *B65B 3/022* (2013.01); *B65D 85/72* (2013.01)

(58) Field of Classification Search
CPC ..... B65D 1/0284; B65B 3/022
(Continued)

(56) References Cited

U.S. PATENT DOCUMENTS 3,514,812 A 6/1970 Evers
3,720,339 A * 3/1973 Khetani ..... B65D 1/0276 215/373

(Continued)

FOREIGN PATENT DOCUMENTS

JP 09-295343 A 11/1997
WO WO-2016019318 A1 * 2/2016 ..... B65D 1/0284

OTHER PUBLICATIONS

Demirel et al. ("Optimization of Poly(ethylene terephthalate) Bottles via Numerical Modeling: A Statistical Design of Experiment Approach", Journal of Applied Polymer Science, vol. 114, 1126-1132(2009)) (Year: 2009).*

(Continued)

*Primary Examiner* — Iftekhar A Khan
(74) *Attorney, Agent, or Firm* — Evershed Sutherland (US) LLP

(57) ABSTRACT

This disclosure provides new carbonated beverage bottle design, particularly carbonated soft drink bottle bases, that can afford improvements in various structural and functional features of the blow molded bottles. The bottle base design can be generated by providing a spherical bottle end cap and extruding at least three (3) feet from the spherical end cap, wherein the center portion of each valley cross section between the extruded feet is convex.

12 Claims, 21 Drawing Sheets

(58) Field of Classification Search
USPC ..... 703/1
See application file for complete search history.

(56) References Cited

U.S. PATENT DOCUMENTS 4,249,667 A * 2/1981 Pocock ..... B65D 1/0284 215/375
4,368,825 A * 1/1983 Motill ..... B65D 1/0284 215/375
4,380,306 A * 4/1983 Knopf ..... B65D 1/12 220/606
4,785,949 A * 11/1988 Krishnakumar ..... B65D 1/0284 215/375
4,865,206 A * 9/1989 Behm ..... B65D 1/0284 215/375
4,892,205 A * 1/1990 Powers ..... B29C 49/0078 215/375
D330,330 S * 10/1992 Behm ..... D9/434
5,160,059 A * 11/1992 Collette ..... B29C 49/0078 215/375
5,335,770 A * 8/1994 Baker ..... B65D 5/503 206/433
5,353,954 A * 10/1994 Steward ..... B65D 1/0284 215/375
5,427,258 A * 6/1995 Krishnakumar ..... B65D 1/0284 215/400
5,454,481 A * 10/1995 Hsu ..... B65D 1/0284 220/608
5,484,072 A * 1/1996 Beck ..... B65D 1/0284 215/375
5,507,402 A * 4/1996 Clark ..... B65D 1/0284 215/375
5,529,196 A * 6/1996 Lane ..... B65D 1/0284 215/375
5,756,018 A * 5/1998 Valyi ..... B29C 49/0078 215/375
5,785,197 A * 7/1998 Slat ..... B65D 1/0284 215/373
5,906,286 A * 5/1999 Matsuno ..... B29C 49/12 215/375
5,988,416 A * 11/1999 Cheng ..... B65D 1/0284 215/375
6,019,236 A * 2/2000 Slat ..... B65D 1/0284 215/375
6,085,924 A * 7/2000 Henderson ..... B65D 1/0284 215/373
6,112,924 A * 9/2000 Zhang ..... B65D 1/0284 215/375
6,276,546 B1 * 8/2001 Davis ..... B65D 1/0284 215/373
6,296,471 B1 * 10/2001 Cheng ..... B29C 33/42 249/117
D510,031 S * 9/2005 Slat ..... D9/520
7,461,756 B2 * 12/2008 Pedmo ..... B65D 1/0284 215/375
7,891,513 B2 * 2/2011 Mody ..... B65D 79/005 215/373
D637,909 S * 5/2011 Fleischhacker ..... D9/502
D651,901 S * 1/2012 Miller ..... D9/516
8,485,375 B2 * 7/2013 Colloud ..... B65D 1/0284 215/375
9,623,999 B2 * 4/2017 Boukobza ..... B65D 1/0284
10,246,210 B2 * 4/2019 Hermel ..... B65D 1/0284
2001/0001200 A1 * 5/2001 Zhang ..... B65D 1/0284 215/375
2002/0084283 A1 * 7/2002 Giblin ..... B65D 1/0215 222/109
2002/0150706 A1 * 10/2002 Tachi ..... B65D 23/0864 428/34.5
2006/0175283 A1 * 8/2006 Piccioli ..... B65D 1/0284 215/375
2008/0245761 A1 * 10/2008 Piccioli ..... B65D 1/0207 215/381
2008/0257855 A1 * 10/2008 Patel ..... B29B 11/14 215/370
2008/0302758 A1 * 12/2008 Mody ..... B65D 1/0284 215/375
2010/0032404 A1 * 2/2010 Colloud ..... B65D 1/0284 215/371
2010/0297375 A1 * 11/2010 Protais ..... B65D 1/0284 428/36.92
2012/0097634 A1 * 4/2012 Riedl ..... B29B 11/14 215/379
2013/0062306 A1 * 3/2013 Quasters ..... B65D 1/16 215/375
2013/0264305 A1 * 10/2013 Boukobza ..... B65D 1/0284 215/375
2014/0183156 A1 * 7/2014 Hanan ..... B65D 1/0284 215/382
2014/0183202 A1 * 7/2014 Hanan ..... B65D 1/0284 220/669
2016/0340072 A1 * 11/2016 Pettersson ..... B65D 1/0284
2017/0217625 A1 * 8/2017 Steward ..... B65D 23/0821
2017/0260003 A1 * 9/2017 Menke ..... B65D 1/0284
2018/0362205 A1 * 12/2018 Pierre ..... B65D 1/0284

OTHER PUBLICATIONS

Noha A. Mohamed ("Evaluation of the Functional Performance for Carbonated Beverage Packaging: A Review for Future Trends", Arts and Design Studies, pp. 53-61, 2016) (Year: 2016).*
Samuel L. Belcher ("Blow Molding", Applied Plastics Engineering Handbook, Elsevier Inc.., 2017, pp. 265-289) (Year: 2017).*
Daver et al. ("An energy saving approach in the manufacture of carbonated soft drink bottles", Procedia Engineering 49 ( 2012 ) 280-286) (Year: 2012).*
PCT International Search Report and Written Opinion for International Application No. PCT/US2015/066049 dated Apr. 14, 2016.
Supplemental European Search Report of European Application No. 15870966.7 dated Aug. 28, 2018.
Russo, Mario, "Polygonal Modeling: Basic and Advanced Techniques," Wordware Publishing, Inc., 2006, pp. 23-41.

* cited by examiner

CARBONATED BEVERAGE BOTTLE BASES AND METHODS OF MAKING THE SAME

CROSS REFERENCE TO RELATED APPLICATIONS

This application claims the benefit of priority of U.S. Provisional Patent Application No. 62/094,450, filed Dec. 19, 2014, which is incorporated by reference in its entirety and PCT Patent Application No. PCT/US2015/066049, filed on Dec. 16, 2015, and published as WO 2016/100483, which is incorporated by reference in its entirety.

TECHNICAL FIELD

This disclosure relates to carbonated beverage bottle design, particularly to carbonated soft drink bottle bases.

BACKGROUND

Polyethylene terephthalate or "PET" polymers and copolymers are widely used to manufacture bottles for beverages such as water, juices, carbonated soft drinks (CSD), and the like, because they generally possess good mechanical and gas barrier properties. Such bottles are conventionally prepared using a stretch blow molding process. Stretch blow molding first involves injecting the PET resin into a perform injection mold designed according to the desired final bottle shape and size and the PET polymer properties. The preform is subsequently stretch blow molded in which the heated perform is both blown and stretched into the final container shape using compressed air and an axial stretching rod.

One significant feature in container design as it relates to the stretch blow molding process and CSD bottle performance is the design of the bottle base. Base design has been found to influence to a substantial degree, for example, the ability to successfully light weight a bottle. Base design also influences bottle performance such as environmental stress crack resistance (ESCR). Processing features, such as the maintenance of bottle integrity during the step of removing the blown bottle from the mold following blow molding are also influenced by bottle base design.

Therefore, improved bottle and base designs are needed that also enable improved light weighting and which allow light weighted bottles to be utilized with existing high speed blow molding equipment. Improvements are also needed in bottle and base design to provide good performance such as thermal stability and environmental stress crack resistance (ESCR) when used with various PET resin compositions. Moreover, the search for more environmentally benign processing conditions, for example, lower pressures or temperatures, is a continuing goal.

DESCRIPTION OF THE INVENTION

The present disclosure provides, among other things, new carbonated beverage bottle designs, particularly free-standing base designs, that can afford improvements in various structural and functional performance features. This disclosure also provides a novel method of constructing a base for a carbonated beverage bottle, typically a CSD bottle with five (5) or six (6) feet. In contrast to conventional methods that involve designing a revolved foot shape and removing multiple valleys to leave behind standing feet, the disclosed method essentially designs a spherical end cap and then extrudes the feet from the spherical end cap for stability. As demonstrated, the base valleys and straps on conventional CSD base designs are not as spherical as the base valleys and straps of the present method. The new methods allow for base valleys and straps to perform better at faster blow molding speeds, reduced air pressure, and reduced base weight, while enhancing base performance (ESCR, thermal stability).

The disclosed base design for CSD bottles is thought to provide enhancements in at least one of the following features. Generally, the disclosed base design can withstand internal pressures common to CSD bottles without substantially or significantly deforming, such that a multiplicity of contact points (feet) enable the bottle to stand upright under pressurized conditions. The CSD base is generally easy to blow to allow for lower blowing pressures as compared to CSD bottles with conventional bases, with consequent potential cost savings. The disclosed base is also generally suitable for production at high operating output speeds found in current state-of-the-art bottle blow-molders. Other structural and functional features that can be found in the blow molded bottles according to this disclosure include base designs that perform successfully for very light-weighted designs, including using the lightest possible weights to fabricate the bottle. The disclosed CSD bottle bases also have a good resistance to environmental stress cracking when fabricated based on the design parameters described herein. Moreover, the base designed as described herein has a sufficiently wide standing diameter and width of feet to provide good stability characteristics.

Further, any combination of these features can also be found in the bottles, bases, and methods of this disclosure. Achieving any combination of some or even most or all of the recited features is a difficult task, because for conventional designs, typically the provision of one of these characteristics usually results in another characteristic being compromised. However, it has been unexpectedly discovered that the disclosed design methods can provide improvement in more than one of these performance and structural features.

In one aspect, the bottle base geometry has been developed using a novel modeling technique which increases or maximizes the proportion of the base which is hemispherical or pseudo-hemispherical, thereby improving the resistance to internal pressure without significant deformation. Increasing the proportion of the base which is hemispherical or pseudo-hemispherical not only enhances resistance to internal pressure, but also allows greater light weighting while generally still offering other desired characteristics such as good resistance to environmental stress cracking.

One method to demonstrate the differences between the CSD base design of the present application and a conventional CSD base design, is provided by examining the various aspects and embodiments of this disclosure are illustrated in the drawings provided herein. Specifically, by demonstrating the novel modeling technique by which the disclosed base geometry is developed, the fundamental differences between the disclosed and conventional base geometry designs can be more readily appreciated. FIGS. 1-10 illustrate the modeling process of this disclosure, which maximizes the proportion of the base which is pseudo-hemispherical (thereby improving resistance to internal pressure without significant deformation) while still delivering various other desired characteristics. FIGS. 11-15 are comparative illustrations, showing how conventional modeling processes provide a traditional CSD bottle base. The various steps of the modeling techniques and processes are now described.

Figure 1:
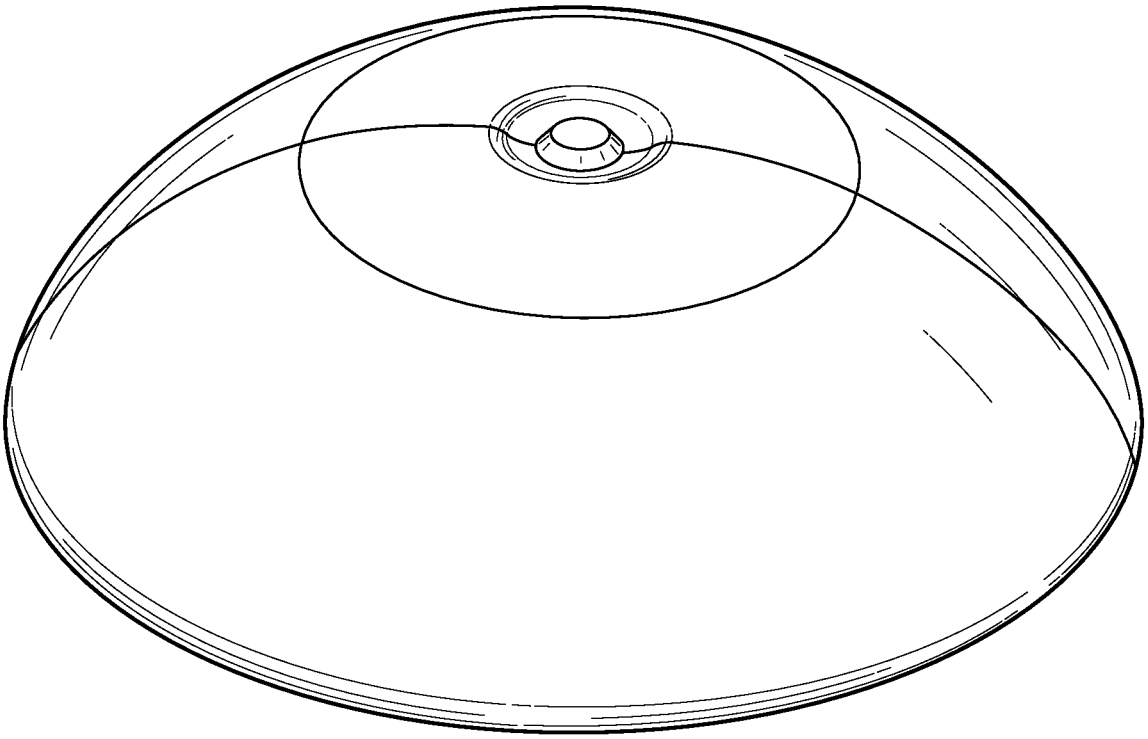
FIG. 1 illustrates a step in the creation of the base according to this disclosure, by creating the hemisphere profile and resolving it. The hemisphere shown is the underlying feature of the disclosed base design onto which the feet are projected.
Figure 2:
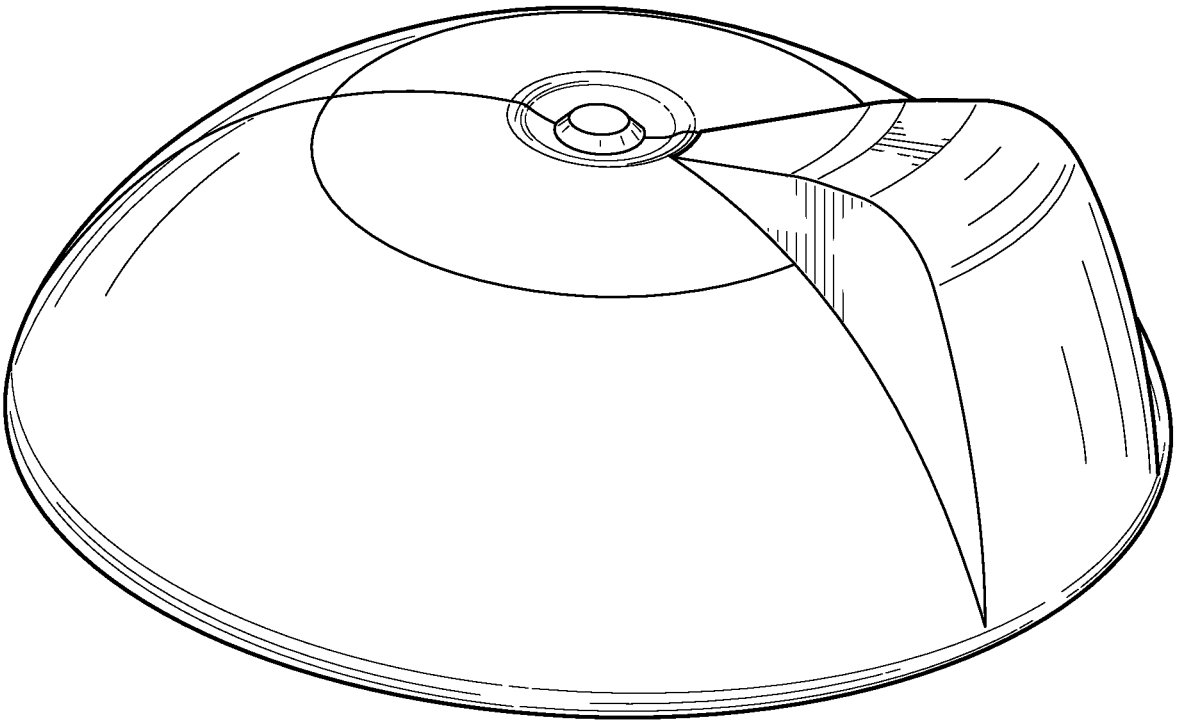
FIG. 2 illustrates a further step in the creation of an inventive base, specifically, creating and part-revolving the foot profile. This figure illustrates a fundamental difference between the disclosed designs and conventional feet designs, that is, the underlying hemispherical structure is maintained and the feet are superimposed or added atop the hemisphere.
Figure 3:
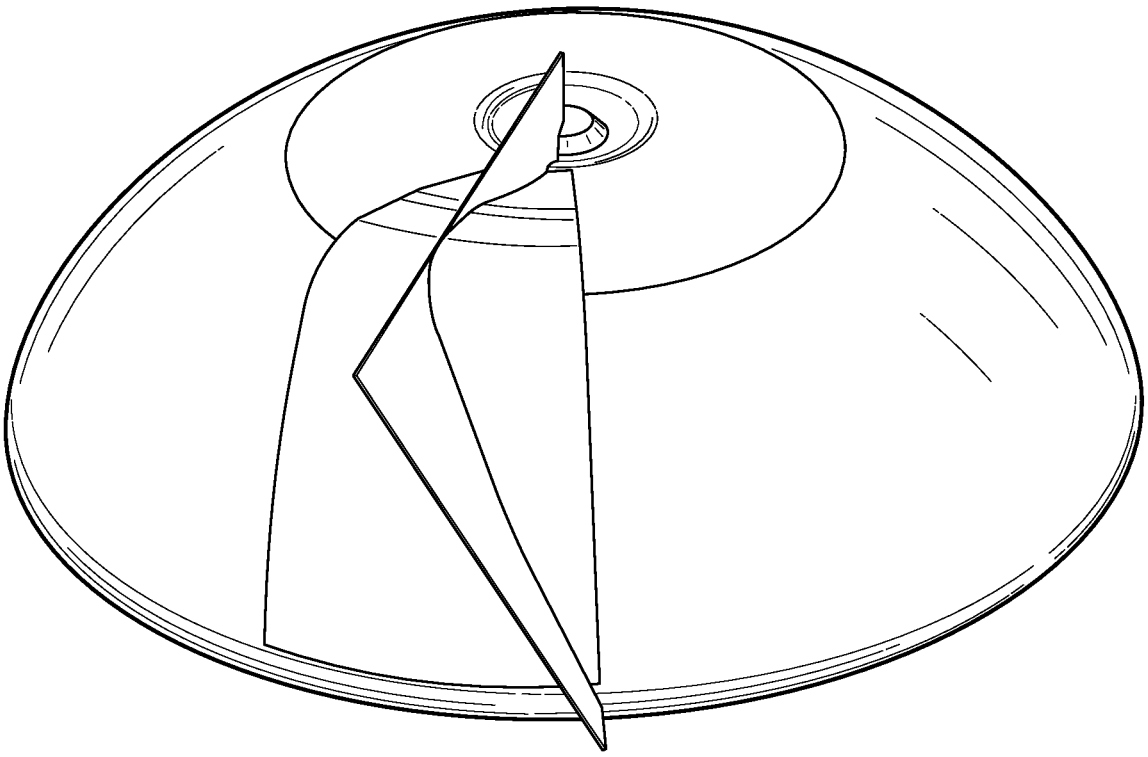
FIG. 3 illustrates another step in the creation of an inventive base, that is, establishing the desired foot width. This figure shows the process for one side or one half a foot, which is mirrored later to construct a complete foot.
Figure 4:
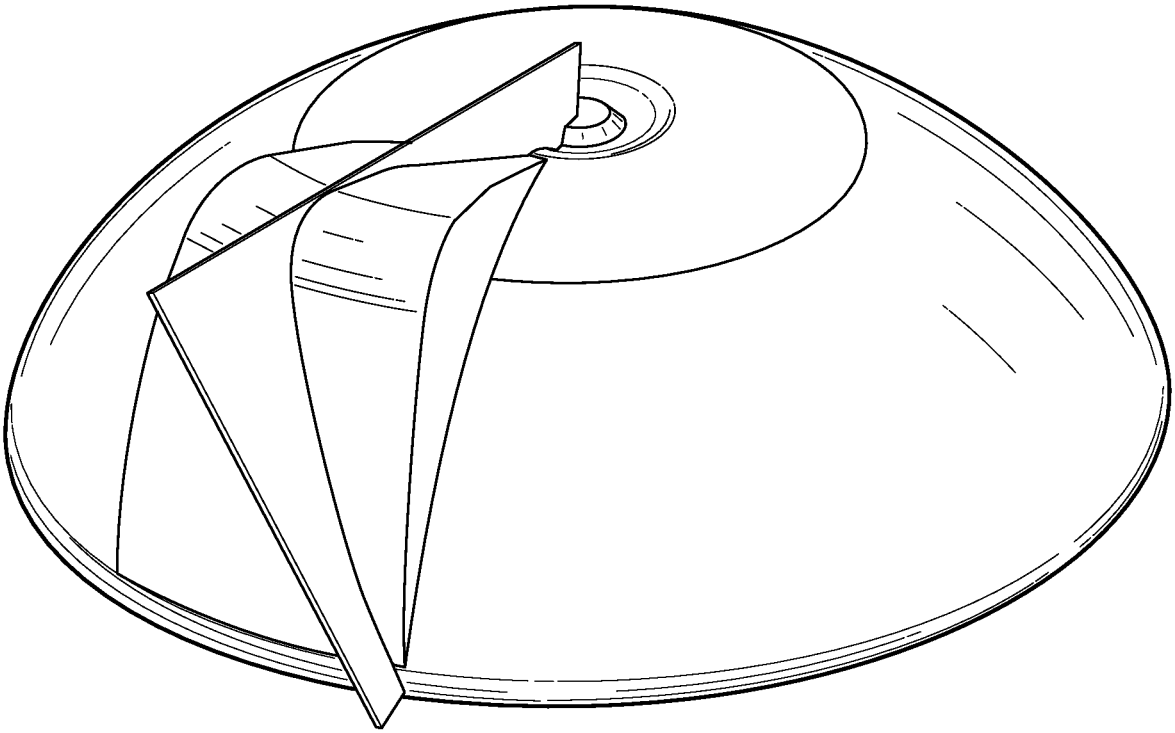
FIG. 4 illustrates still another step in the creation of an inventive base, that is, establishing the angle of valley sides between feet with a second control line and creating a "splitting surface".
Figure 5:
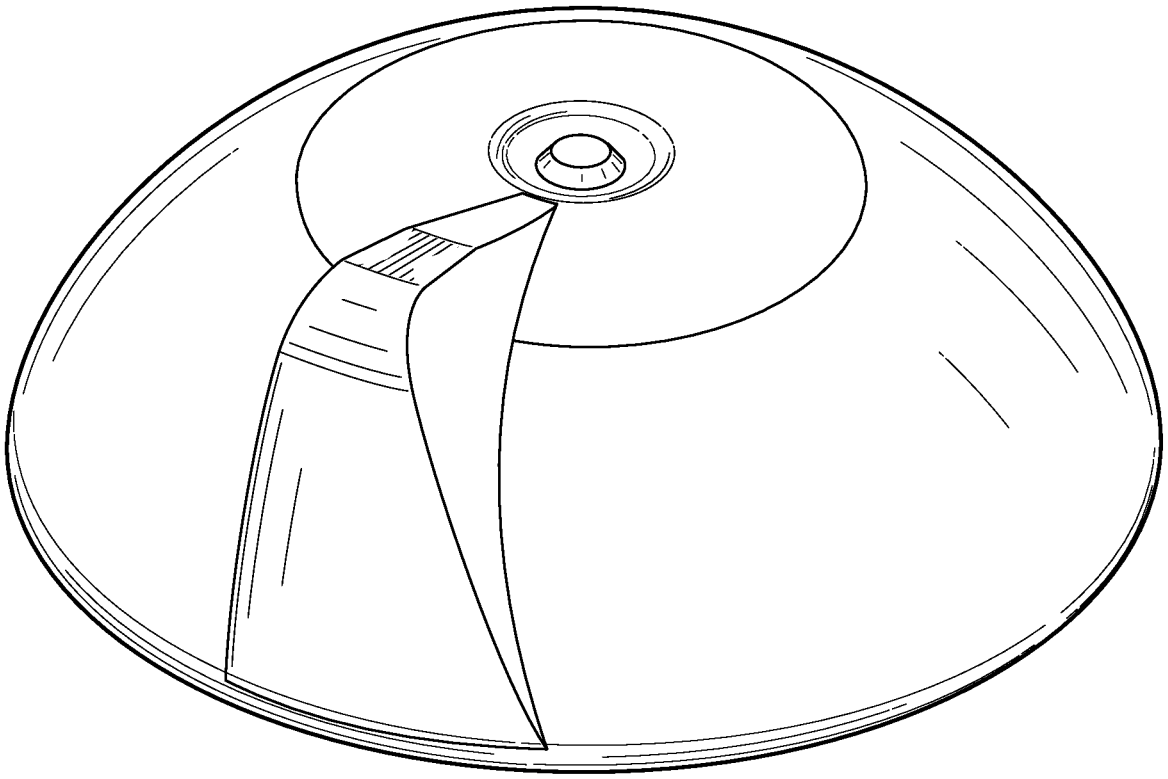
FIG. 5 illustrates yet a further step in the creation of an inventive base, by using the splitting surface to remove the unwanted part of foot, to further define the valley sides that will be formed between adjacent feet.
Figure 6:
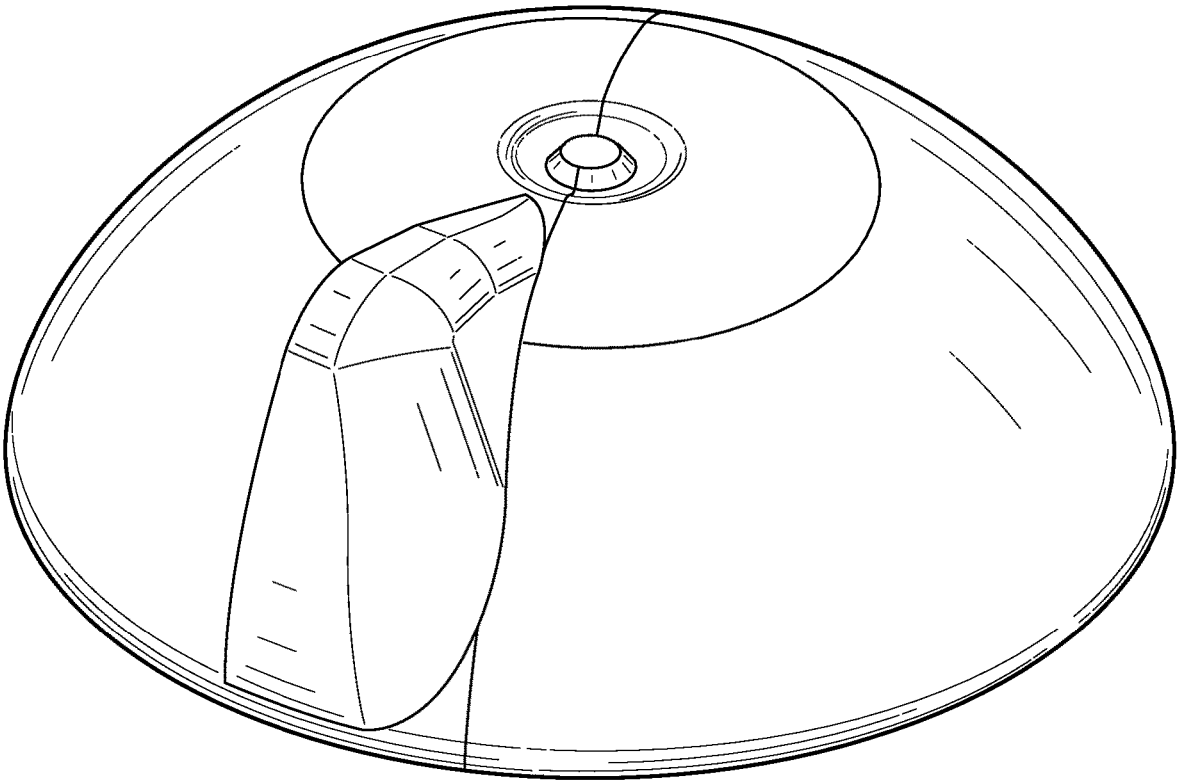
FIG. 6 illustrates a next step in the creation of an inventive base, specifically by adding a variable sized fillet radius along a corner edge of foot. Again, this process is demonstrated for one side or one half the foot as shown, which is later mirrored later to construct a complete foot.
Figure 7:
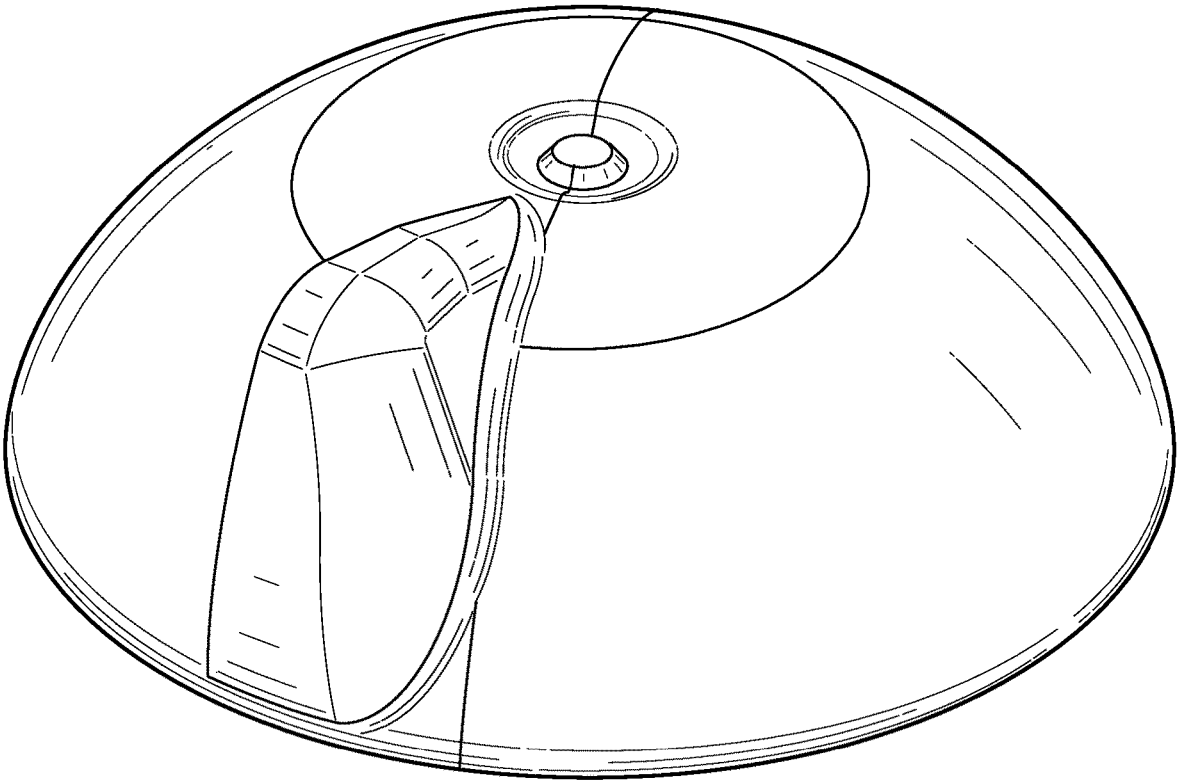
FIG. 7 illustrates a subsequent step in the creation of an inventive base, by adding a fillet radius between foot and hemisphere for one half the foot as shown.
Figure 8:
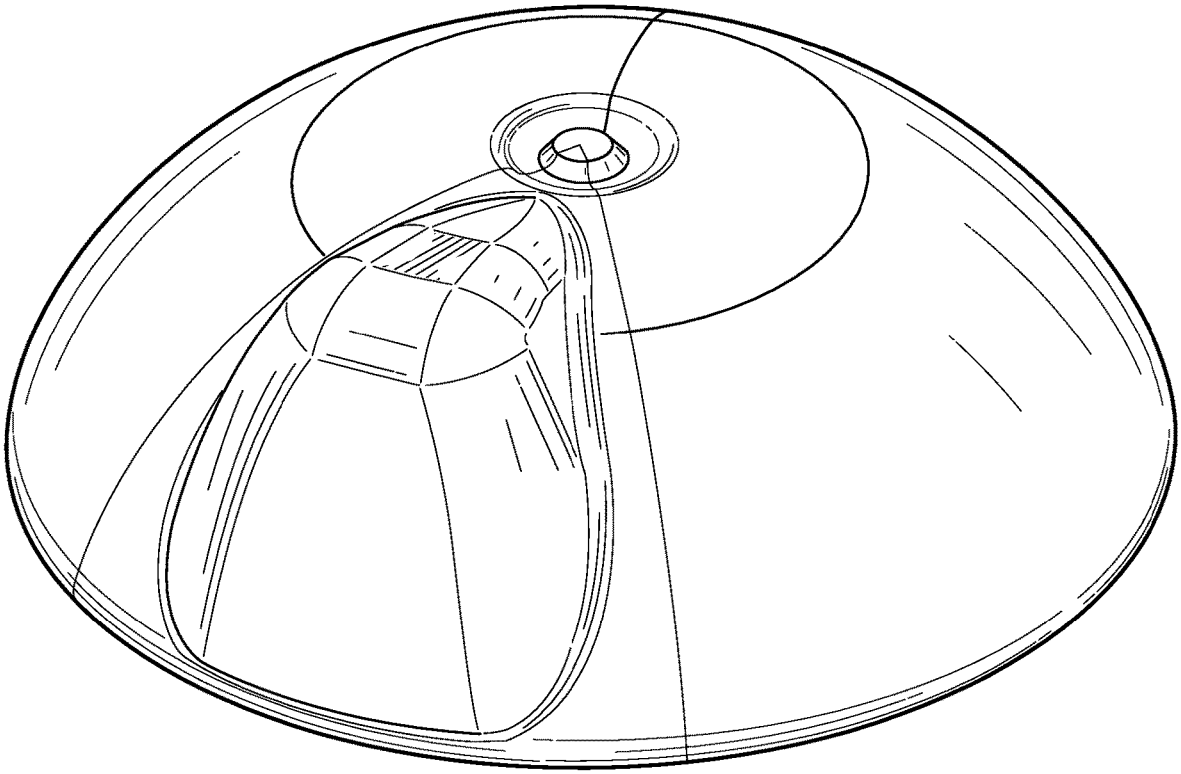
FIG. 8 illustrates a further step in the creation of an inventive base, that is, creating a mirror image to mirror the half foot, to make a complete foot.
Figure 9:
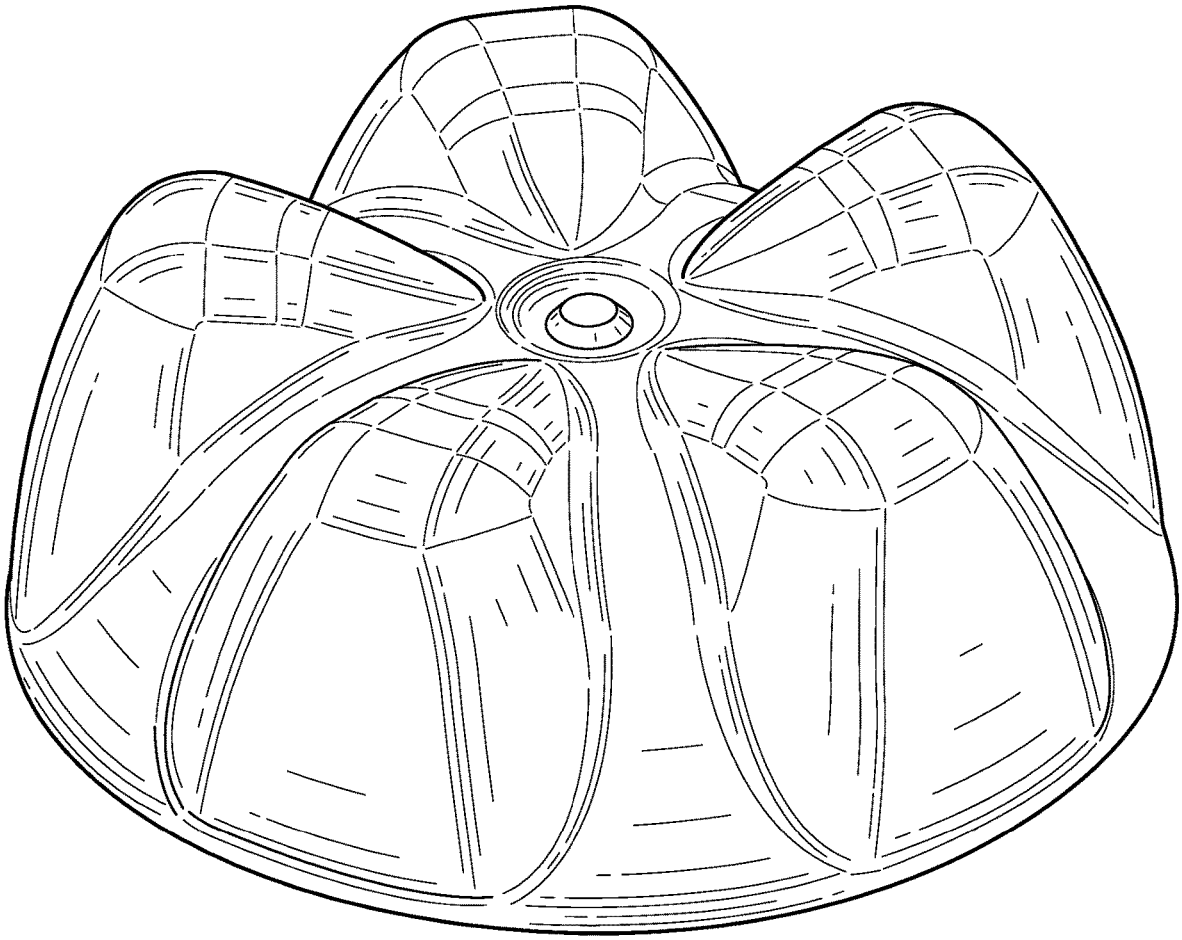

FIG. 9 illustrates yet a further step in the creation of an inventive base, by copy-rotating the created foot five (5)-times, to make complete base. In some embodiments, the foot can be created and copy-rotating less than or more than five times, if desired. This figure illustrates that, in contrast to the conventional designs, the center portion of the cross section of the valleys between bottle feet are convex, that is indented or depressed toward the outside or exterior of the bottle. This figure illustrates one difference between corresponding conventional bottle bases, that is, the individual feet in the base according to this disclosure are individually "resolved" from the underlying hemispherical structure, so that feet are distinct and separate and the hemispherical structure of the valleys separating the feet is clear.

Figure 10:
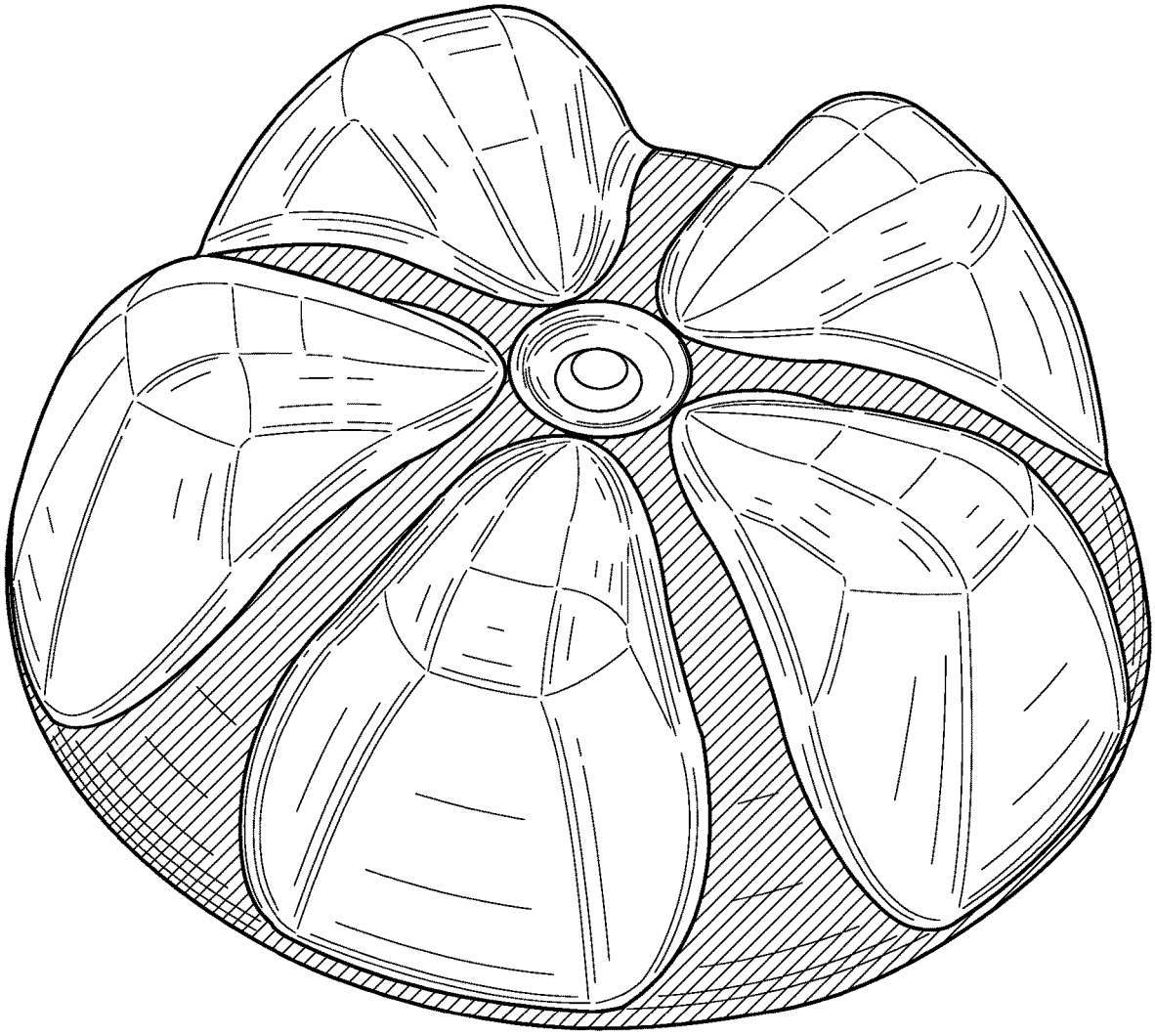

FIG. 10 illustrates by the shaded area, the proportion of the base which remains hemispherical or "pseudo-hemispherical", and the convex cross section of the center portion of the valleys between bottle feet, wherein the cross section is indented or depressed toward the outside or exterior of the bottle. Again, the "resolution" of the individual feet in the base from the underlying hemispherical structure is distinct. The retention of larger swaths of pseudo-hemispherical base portions contributes to the ability of the base to withstand internal pressure forces that act to try to deform the base in such a way that the center of the base is pushed downwards. If the base center were to drop below the level of the feet, the base would become unstable and the bottle would fall over. Therefore, the advantages of controlling this particular performance parameter can be seen by the relative location of the shaded hemispherical portion of the base relative to the feet that were designed and fabricated according to the figures.

A further aspect of the disclosure illustrated in FIG. 10 is the portion or fraction of the original hemisphere profile that is retained in the complete bottle base, shown in the shaded area in FIG. 10, that is, the resolution of the individual feet from the underlying hemispherical structure. In an aspect, from about 5 area % to about 45 area % of the hemisphere profile can be retained in the complete bottle base. Other aspects provide that from about 10 area % to about 40 area %, from about 20 area % to about 35 area %, or from about 25 area % to about 30 area % of the hemisphere profile can be retained in the complete bottle base. That is, the area percentage of the hemisphere profile that can be retained in the complete bottle base can be about 5, about 10, about 15, about 20, about 25, about 30, about 35, about 40, or about 45 area %, including any range or ranges between any of these area percentages. In further examples and aspects, the area percentage of the hemisphere profile that can be retained in the complete bottle base can be about 5, 6, 7, 8, 9, 10, 11, 12, 13, 14, 15, 16, 17, 18,19, 20, 21, 22, 23, 24, 25, 26, 27, 28, 29, 30, 31, 32, 33, 34, 35, 36, 37, 38, 39, 40, 41, 42, 43, 44, or about 45 area %.

FIGS. 11-15 demonstrate some differences between the CSD base design of the present application and a conventional CSD base design, by illustrating steps by which a conventional or traditional base is designed, as a comparative example.

Figure 11:
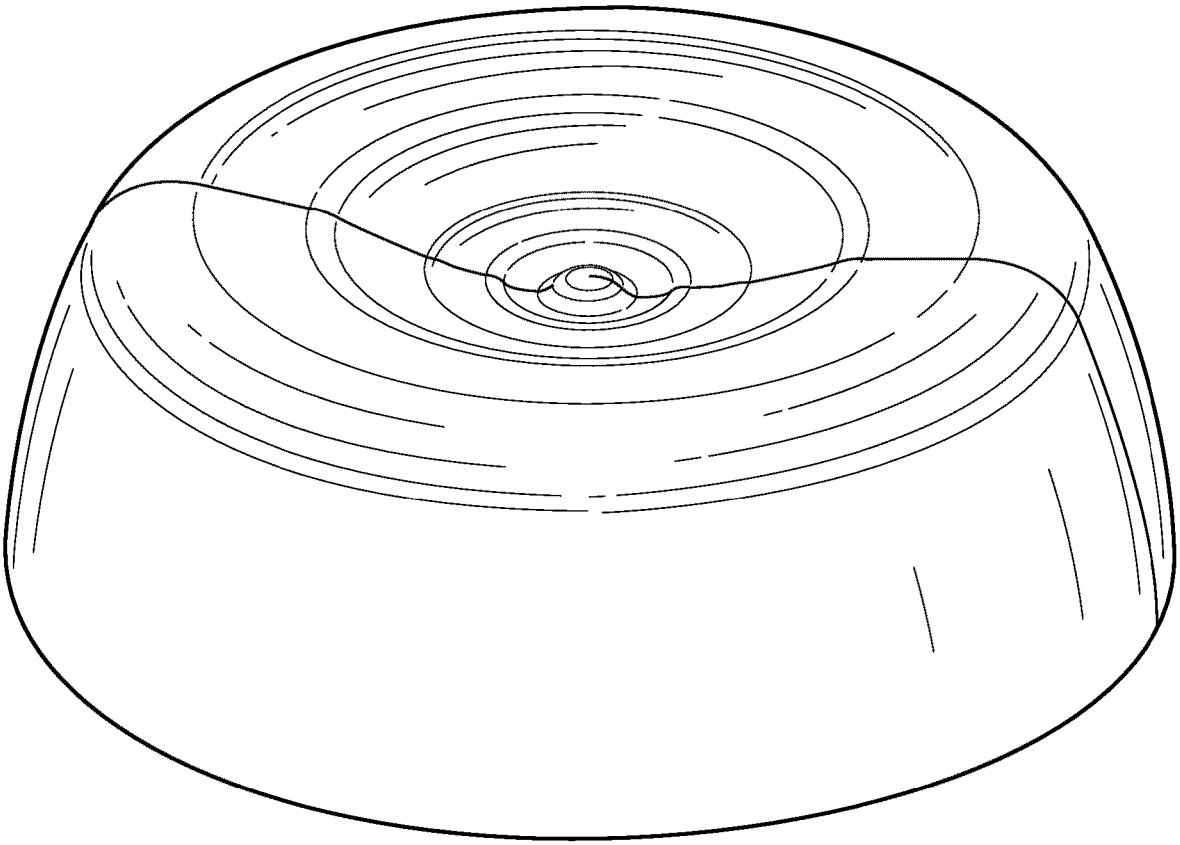

FIG. 11 illustrates a first step in the creation of a traditional base such a PET bottle base for carbonated beverages, by revolving a foot profile to make a complete 360° circle base. This illustrates a conventional method in which the underside of the base itself is concave (indented or depressed toward the inside or interior of the bottle).

Figure 12:
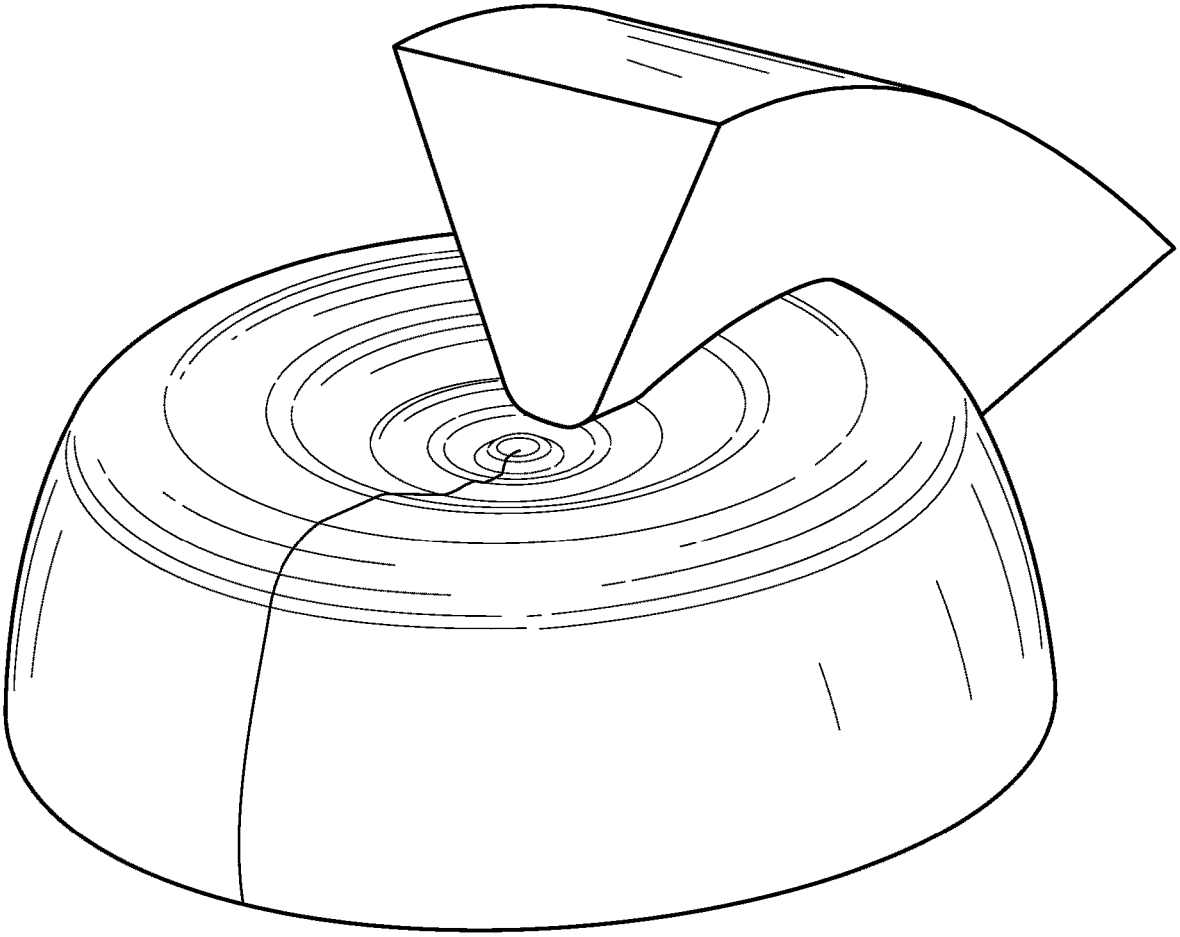

FIG. 12 illustrates a further step in the creation of a comparative, conventional base, that is, creating a V-shaped valley portion which forms a typical space between the feet.

Figure 13:
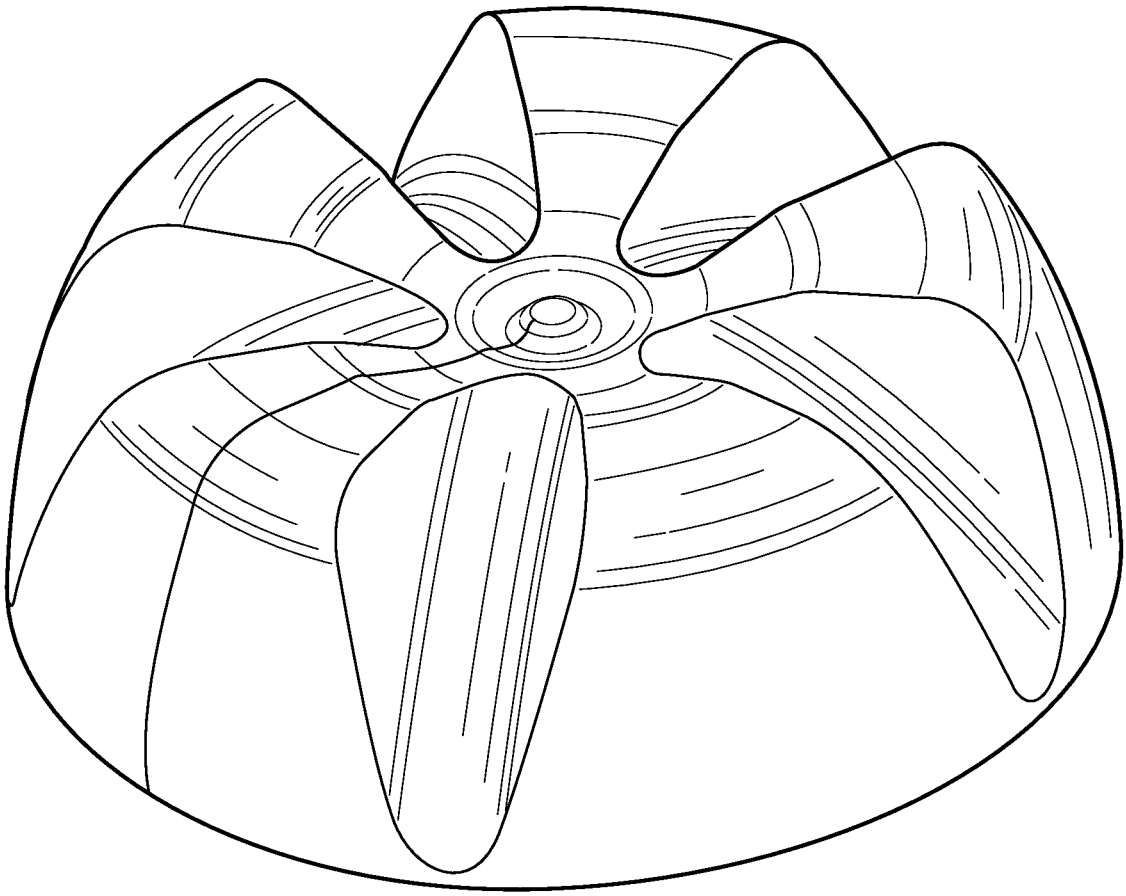

FIG. 13 illustrates a further step in the creation of a comparative, conventional base, that is, after being copy-rotated 5 times (for example), the V-shaped valleys are subtracted from the revolved base leaving behind the basic form of the feet. As can be seen from this figure even before smoothing off the sharp edges of this conventional or traditional base design, the center portion of the cross section of the valleys between bottle feet are concave, that is, indented or depressed toward the inside or interior of the bottle.

Figure 14:
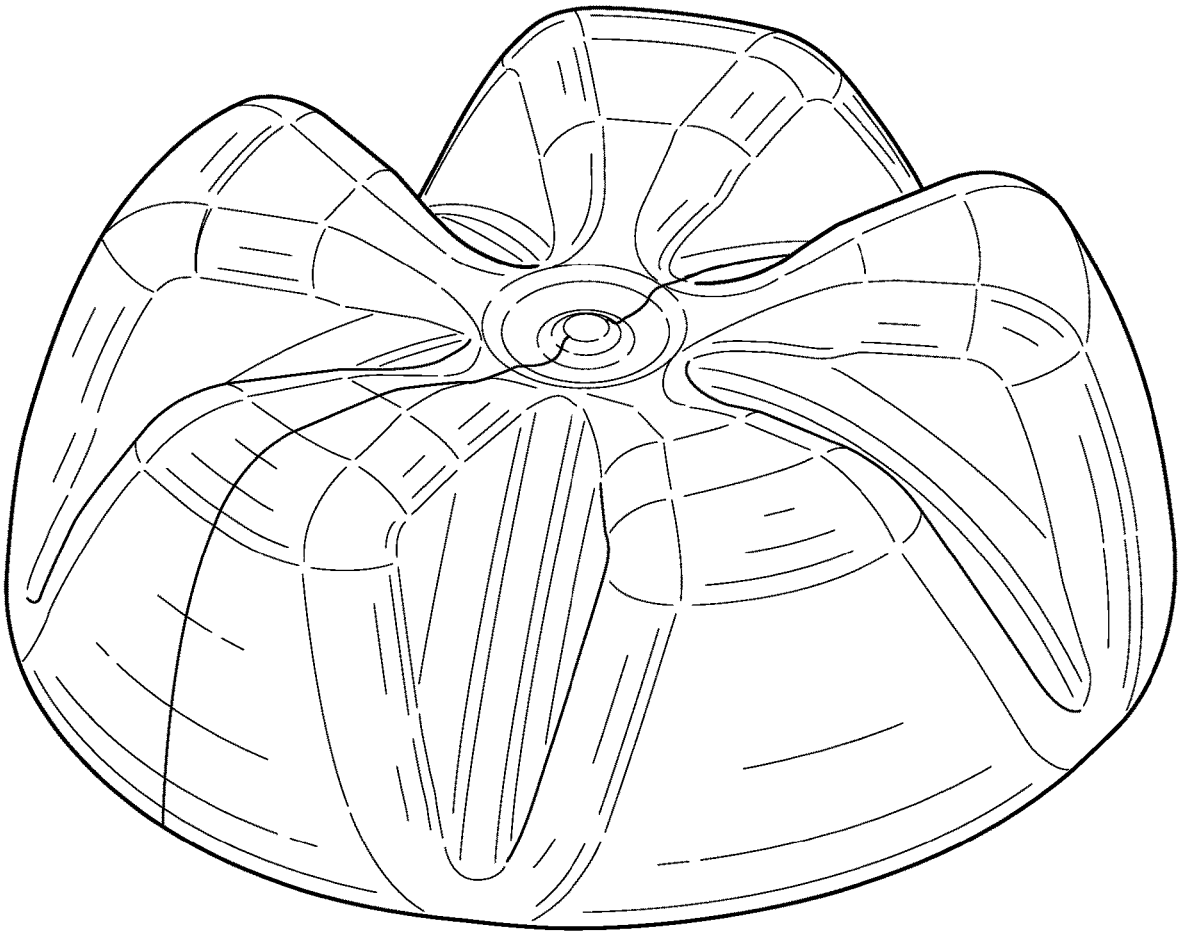

FIG. 14 illustrates the result of a further smoothing step following the copy-rotation in the creation of a comparative, conventional base, and after smoothing off the sharp edges a typical base design can be seen in this figure. This figure also illustrates that the center portion of the cross section of the valleys between bottle feet in the conventional base design are concave and indented or depressed toward the inside or interior of the bottle.

Figure 15:
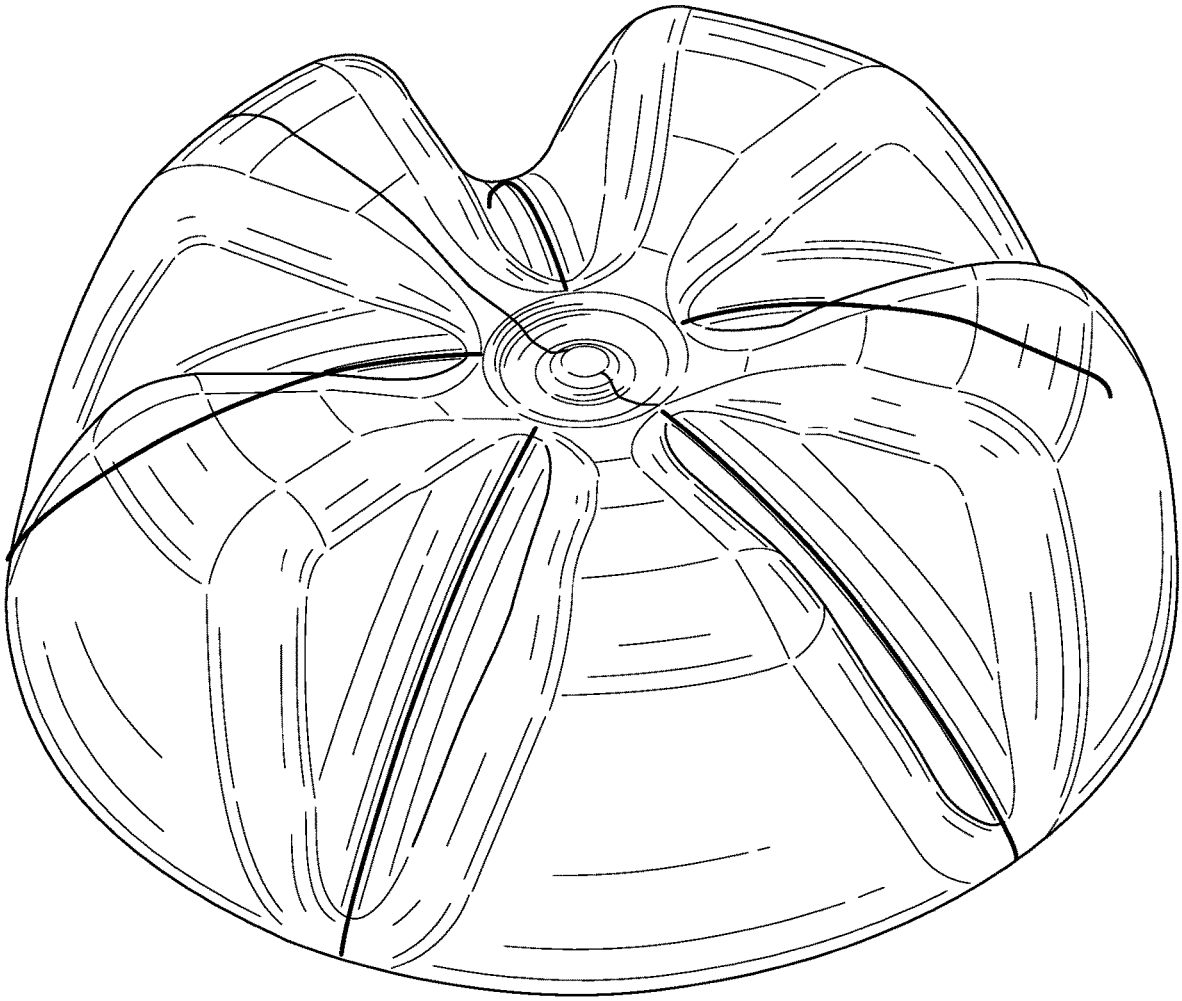

FIG. 15 illustrates one feature of structural property of the comparative, conventional base, that is, formed by the traditional method, that is, It can be observed from this method that the only areas of the base which show a pseudo-hemispherical structure are illustrated by the red-colored lines which run down the mid-point of each valley. This figures illustrates that less of the base shows a hemispherical or pseudo-hemispherical structure using the traditional design methodology as compared to the design methodology of this disclosure. For example, when bottles having a conventional versus the disclosed bases are sitting upright on a surface, the upper (further from the surface) edge of the feet are still bounded by the hemispherical or pseudo-hemispherical structure in the disclosed and claimed design, whereas they are not in the traditional design.

Figure 16:
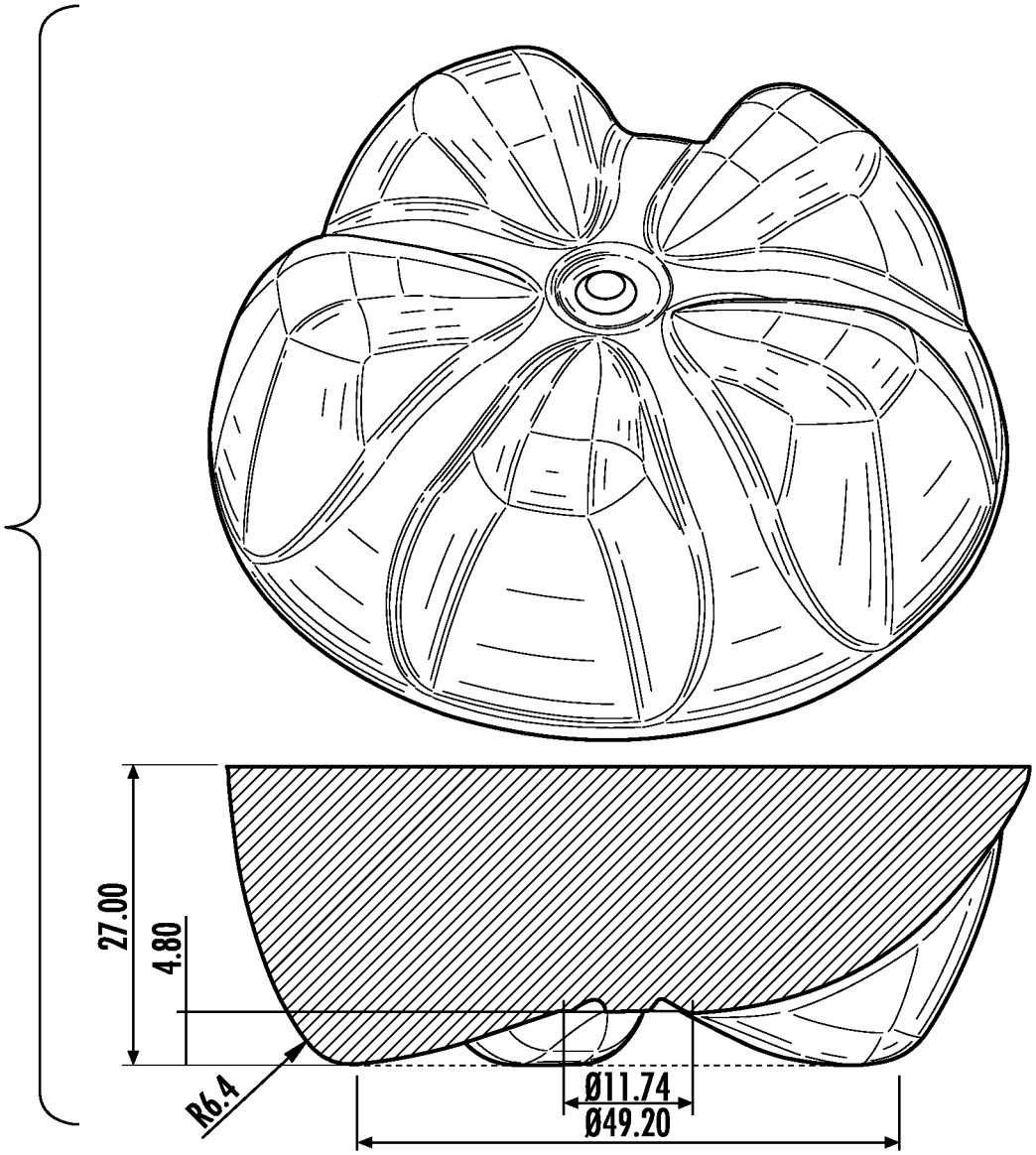
Figure 17:
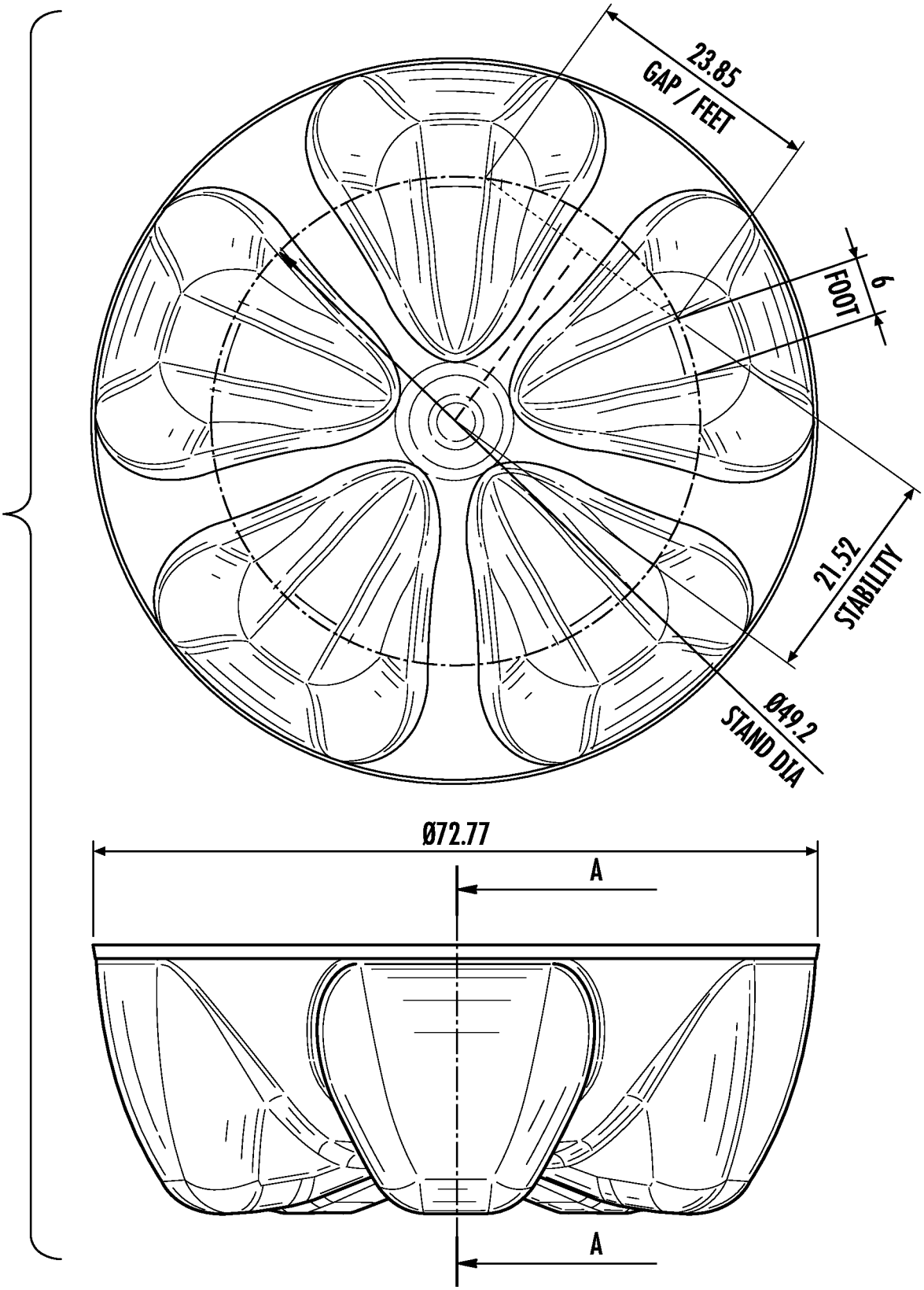

FIGS. 16 and 17 illustrate dimensions of a five (5)-footed CSD bottle base with an enhanced pseudo-hemispherical portion manufactured with the disclosed design parameters and method, in accordance with Example 1 and Table 1 of the present application.

Figure 18:
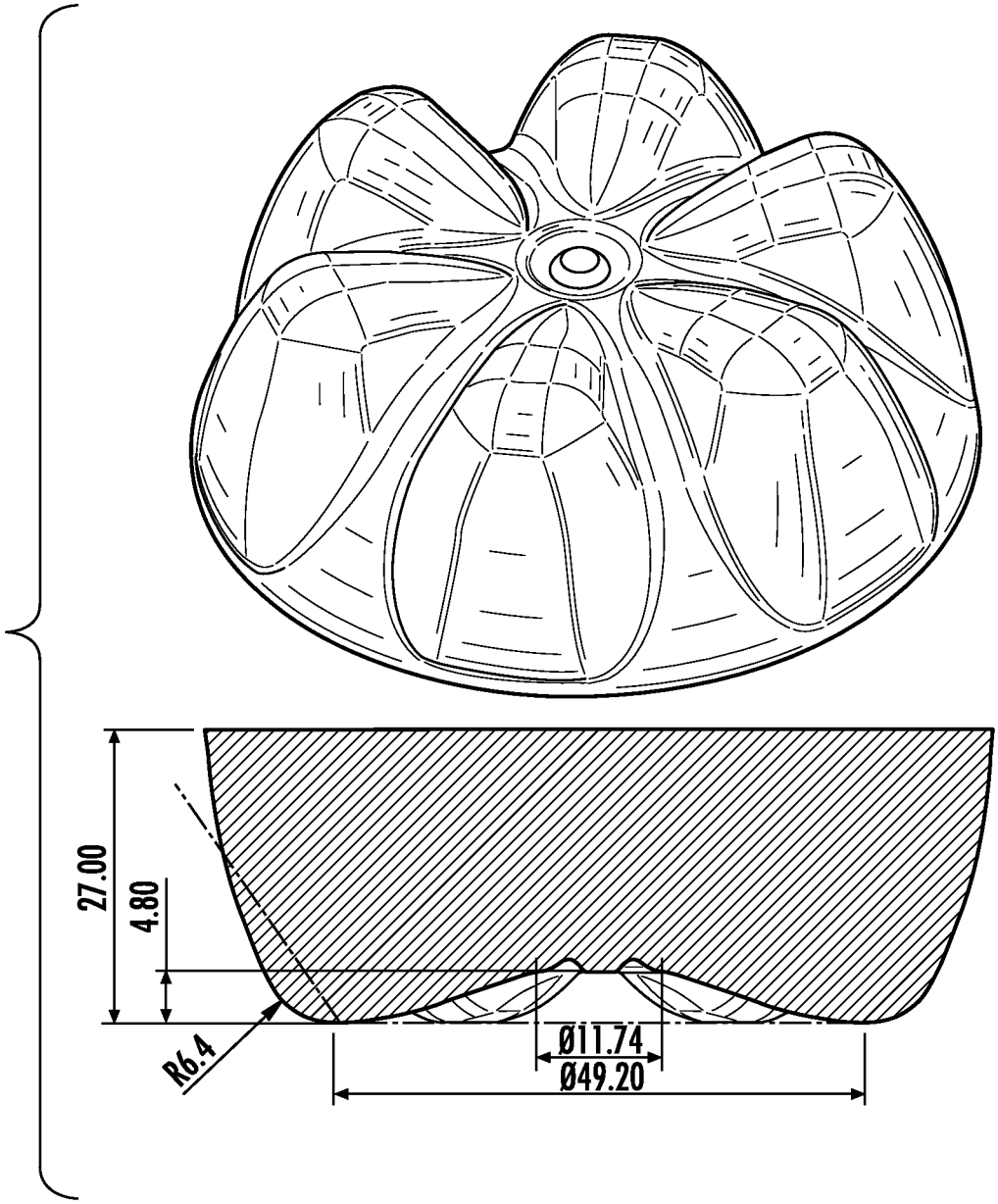
Figure 19:
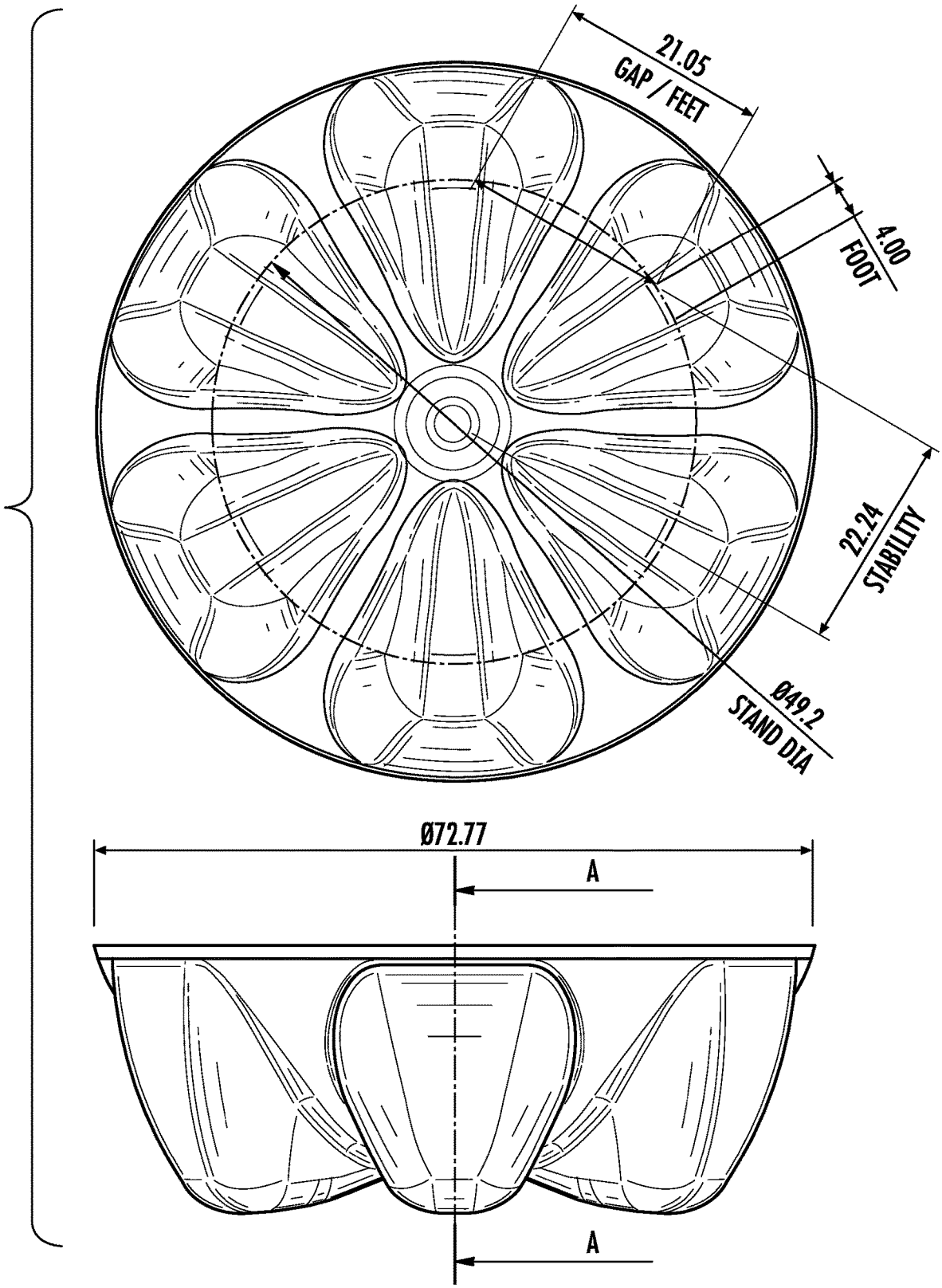

FIGS. 18 and 19 illustrate dimensions of a six (6)-footed CSD bottle base with an enhanced pseudo-hemispherical portion manufactured with the disclosed design parameters and method, in accordance with Example 2 and Table 2 of the present application.

Figure 20:
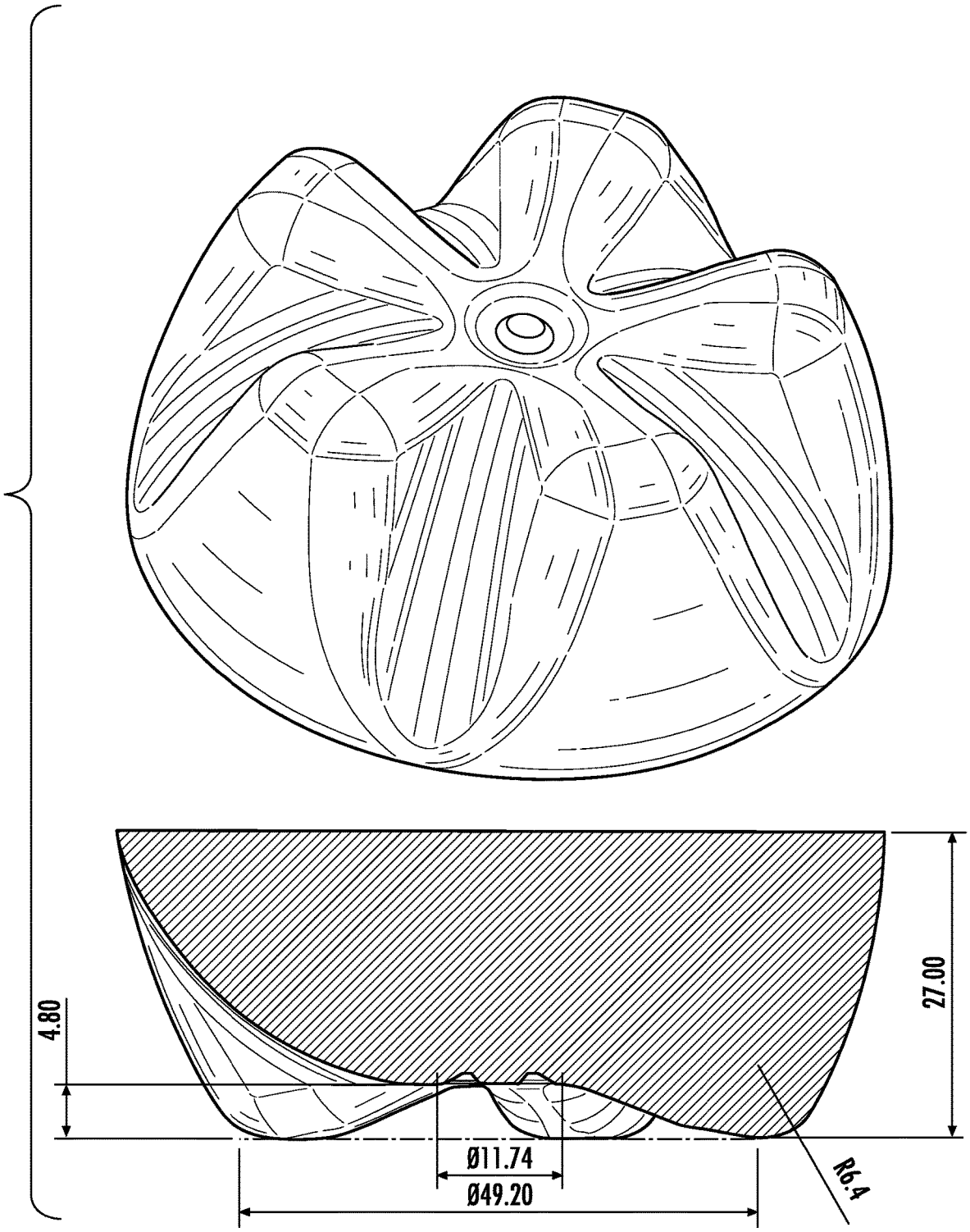
Figure 21:
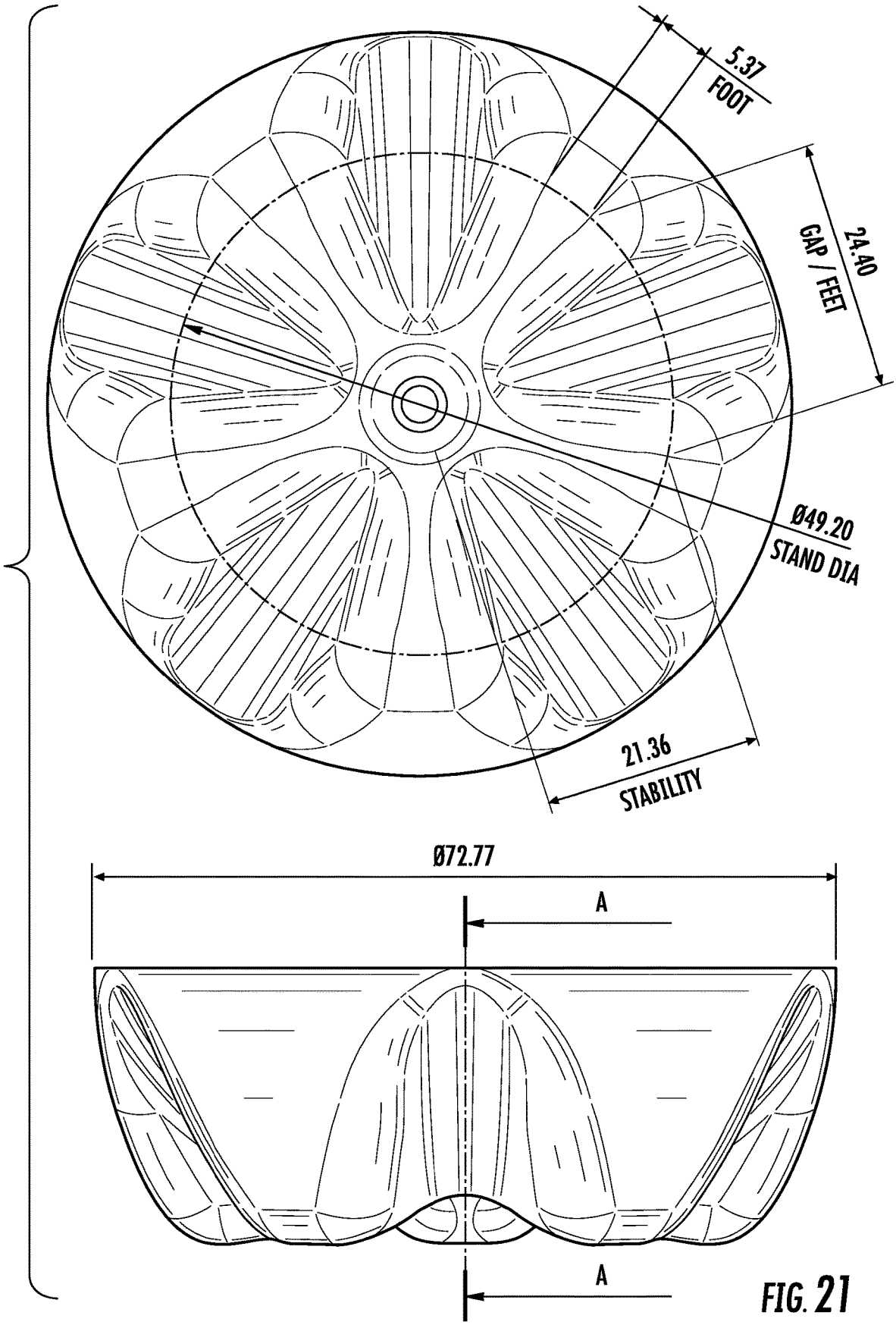

FIGS. 20 and 21 illustrate dimensions of a five (5)-footed CSD bottle base manufactured by a conventional method, in accordance with Example 3 and Table 3 of the present application.

In an aspect, bottles incorporating the base designs disclosed herein can show improvements in, among other things, the Environmental Stress Crack Resistance (ESCR) (see, for example, ASTM D883). In an aspect, the ESCR of a bottle made with a base design according to this disclosure can show an improvement in ESCR of about 5%, about 10%, about 15%, about 20%, about 25%, about 30%, about 35%, about 40%, about 45%, or about 50% as compared to the ESCR of a corresponding bottle made with a conventional base design as described herein. Alternatively, the ESCR of a bottle made with a base design according to this disclosure can show an improvement in ESCR of at least about any of the aforementioned percentage improvements. Stress cracks are generally thought to initiate at microscopic imperfections and propagate through the crystalline regions of the polymer structure. It has been unexpectedly discovered that using the same polymer and same conditions except for the base design can show the improvements in ESCR as set out herein.

EXAMPLES

Example 1

Five (5)-Footed CSD Bottle Base with Improved Pseudo-Hemispherical Portion

The disclosed design parameters and method were used to generate a 20 ounce, five (5)-footed CSD bottle base with an enhanced pseudo-hemispherical portion, by initially designing a spherical end cap and subsequently extruding the feet from the spherical end cap. The resulting 5-footed CSD bottle base is shown in FIGS. 16 and 17. Specific structural measurements for the CSD bottle base illustrated in these figures are reported in Table 1. In this example, the proportion of the hemisphere which remains after the feet have been added was found to be about 27-28 area %.

TABLE 1

Structural parameters for a 20 ounce 5-footed CSD bottle base.

| | |
|---|---|
| BASE HEIGHT | 27.00 mm |
| STANDING DIAMETER | 49.20 mm |
| FOOT WIDTH | 6.00 mm (5 FEET) |
| GAP BETWEEN ADJACENT FEET | 23.85 mm |
| STABILITY DISTANCE | 21.52 mm |
| SURFACE AREA | 83.19 sq/cm |
| ENCLOSED VOLUME | 78.14 ml |
| CENTER GROUND CLEARANCE | 4.80 mm |

Example 2

Six (6)-Footed CSD Bottle Base with Improved Pseudo-Hemispherical Portion

The disclosed design parameters and method were used to generate a 20 ounce, six (6)-footed CSD bottle base with an enhanced pseudo-hemispherical portion, by initially designing a spherical end cap, and subsequently extruding the feet from the spherical end cap. The resulting 6-footed CSD bottle base is shown in FIGS. 18 and 19. Specific structural measurements for the CSD bottle base illustrated in these figures are reported in Table 2.

TABLE 2

Structural parameters for a 20 ounce 6-footed CSD bottle base.

| | |
|---|---|
| BASE HEIGHT | 27.00 mm |
| STANDING DIAMETER | 49.20 mm |
| FOOT WIDTH | 4.00 mm (6 FEET) |
| GAP BETWEEN ADJACENT FEET | 21.05 mm |
| STABILITY DISTANCE | 22.24 mm |
| SURFACE AREA | 85.54 sq/cm |
| ENCLOSED VOLUME | 78.79 ml |
| CENTER GROUND CLEARANCE | 4.80 mm |

Example 3

Comparative Five (5)-Footed CSD Bottle Base with Conventional Base

As a comparative example, a conventional method was used to design a five (5)-footed CSD bottle base. This conventional or traditional method involved designing a revolved foot shape and removing multiple valleys to leave behind standing feet. The resulting 5-footed CSD bottle base with a conventional base is shown in FIGS. 20 and 21. As these figures demonstrate the base valleys and straps on conventional CSD base designs are not as spherical as the base valleys and straps of the present method. Specific structural measurements for the conventional CSD bottle base illustrated in these figures are reported in Table 3.

TABLE 3

Structural parameters for a conventional 20 ounce 5-footed CSD bottle base.

| | |
|---|---|
| BASE HEIGHT | 27.00 mm |
| STANDING DIAMETER | 49.20 mm |
| FOOT WIDTH | 5.37 mm (5 FEET) |
| GAP BETWEEN ADJACENT FEET | 24.40 mm |
| STABILITY DISTANCE | 21.36 mm |
| SURFACE AREA | 83.14 sq/cm |
| ENCLOSED VOLUME | 79.52 ml |
| CENTER GROUND CLEARANCE | 4.80 mm |

Definitions

To define more clearly the terms used herein, the following definitions are provided, which are applicable to this disclosure unless otherwise indicated by the disclosure or the context. To the extent that any definition or usage provided by any document incorporated herein by reference conflicts with the definition or usage provided herein, the definition or usage provided herein controls.

The terms "carbonated beverage" is used herein to refer primarily to, but not be restricted to, carbonated soft drinks (CSD). Unless otherwise specified or the context requires otherwise, the use of either "carbonated beverage" or "carbonated soft drink" encompasses the other term. That is, unless specified to the contrary or required otherwise by the context, these terms are used interchangeably.

The term "concave" is used herein to describe surfaces of the bottle or base that are indented or depressed toward the inside of the bottle.

The term "convex" is used herein to describe surfaces of the bottle or base that are indented or depressed toward the outside of the bottle.

Throughout this specification, various publications may be referenced. The disclosures of these publications are hereby incorporated by reference in pertinent part, in order to more fully describe the state of the art to which the disclosed subject matter pertains. The references disclosed are also individually and specifically incorporated by reference herein for the material contained in them that is discussed in the sentence in which the reference is relied upon. To the extent that any definition or usage provided by any document incorporated herein by reference conflicts with the definition or usage applied herein, the definition or usage applied herein controls.

As used in the specification and the appended claims, the singular forms "a," "an," and "the" include plural referents, unless the context clearly dictates otherwise. Thus, for example, reference to "a projectile" includes a single projectile such as a slug, as well as any combination of more than one projectile, such as multiple pellets of shot of any size or combination of sizes. Also for example, reference to "a projectile" includes multiple particles of a chemical composition or mixture of compositions that constitutes a projectile, and the like.

Throughout the specification and claims, the word "comprise" and variations of the word, such as "comprising" and "comprises," means "including but not limited to," and is not intended to exclude, for example, other additives, components, elements, or steps. While compositions and methods are described in terms of "comprising" various components or steps, the compositions and methods can also "consist essentially of" or "consist of" the various components or steps.

"Optional" or "optionally" means that the subsequently described element, component, step, or circumstance can or cannot occur, and that the description includes instances where the element, component, step, or circumstance occurs and instances where it does not.

Unless indicated otherwise, when a range of any type is disclosed or claimed, for example a range of the particle sizes, percentages, temperatures, and the like, it is intended to disclose or claim individually each possible number that such a range could reasonably encompass, including any sub-ranges or combinations of sub-ranges encompassed therein. When describing a range of measurements such as sizes or weight percentages, every possible number that such a range could reasonably encompass can, for example, refer to values within the range with one significant figure more than is present in the end points of a range, or refer to values within the range with the same number of significant figures as the end point with the most significant figures, as the context indicates or permits. For example, when describing a range of percentages such as from 25% to 35%, it is understood that this disclosure is intended to encompass each of 25%, 26%, 27%, 28%, 29%, 30%, 31%, 32%, 33%, 34%, and 35%, as well as any ranges, sub-ranges, and combinations of sub-ranges encompassed therein. Applicants' intent is that these two methods of describing the range are interchangeable. Accordingly, Applicants reserve the right to proviso out or exclude any individual members of any such group, including any sub-ranges or combinations of sub-ranges within the group, if for any reason Applicants choose to claim less than the full measure of the disclosure, for example, to account for a reference that Applicants are unaware of at the time of the filing of the application.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed therein, and that each value is also herein disclosed as "about" that particular value in addition to the value itself. In another aspect, use of the term "about" means±20% of the stated value, ±15% of the stated value, ±10% of the stated value, ±5% of the stated value, or ±3% of the stated value.

In any application before the United States Patent and Trademark Office, the Abstract of this application is provided for the purpose of satisfying the requirements of 37 C.F.R. § 1.72 and the purpose stated in 37 C.F.R. § 1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

Those skilled in the art will readily appreciate that many modifications are possible in the exemplary embodiments disclosed herein without materially departing from the novel teachings and advantages according to this disclosure. Accordingly, all such modifications and equivalents are intended to be included within the scope of this disclosure as defined in the following claims. Therefore, it is to be understood that resort can be had to various other aspects, embodiments, modifications, and equivalents thereof which, after reading the description herein, may suggest themselves to one of ordinary skill in the art without departing from the spirit of the present disclosure or the scope of the appended claims.

Further attributes, features, and embodiments of the present invention can be understood by reference to the following numbered aspects of the disclosed invention. Reference to disclosure in any of the preceding aspects is applicable to any preceding numbered aspect and to any combination of any number of preceding aspects, as recognized by appropriate antecedent disclosure in any combination of preceding aspects that can be made. The following numbered aspects are provided:

1. A method of mathematically generating a bottle base, the method comprising:

a) creating and resolving a hemisphere profile of a bottle base;

b) while maintaining the hemisphere profile, creating and partially revolving a foot profile, wherein the foot profile is superimposed atop the hemisphere profile;

c) for one-half of the foot, establishing a foot width and an angle of a valley side of the foot and removing a portion of the foot to define the valley side;

d) for the same half of the foot, adding a variable sized fillet radius along a corner edge of the foot and adding a fillet radius between the foot and the hemisphere profile;

e) creating a mirror image for the one-half of the foot to make a complete foot; and f) copy-rotating the created foot a plurality of times, to make a complete bottle base.

2. A method according to any of the preceding aspects, wherein the bottle is a carbonated soft drink bottle.

3. A method according to any of the preceding aspects, wherein the created foot is copy-rotating five (5) times to make a complete bottle base having five feet.

4. A method according to any of the preceding aspects, wherein the created foot is copy-rotating six (6) times to make a complete bottle base having six feet.

5. A method according to any of the preceding aspects, wherein the center portion of each cross section of the valleys between bottle feet are convex.

6. A method according to any of the preceding aspects, wherein from about 1 area % to about 20 area % of the hemisphere profile is retained in the complete bottle base.

7. A method according to any of the preceding aspects, wherein from about 2 area % to about 15 area % of the hemisphere profile is retained in the complete bottle base.

8. A method according to any of the preceding aspects, wherein the ESCR of the bottle is at least about 5% greater than the ESCR of a corresponding bottle made with a conventional base design.

9. A method according to any of the preceding aspects, wherein the ESCR of the bottle is at least about 10% greater than the ESCR of a corresponding bottle made with a conventional base design.

10. A method of generating a bottle base, the method comprising:

a) providing a spherical end cap; and b) extruding at least three (3) feet from the spherical end cap, wherein the center portion of each valley cross section between the extruded feet is convex.

11. A method according to aspect 10, wherein five (5) feet are extruded from the spherical end cap.

12. A method according to aspect 10, wherein six (6) feet are extruded from the spherical end cap.

13. A method according to aspects 10-12, wherein the bottle is a carbonated soft drink bottle.

14. A bottle comprising a base generated by the method according to any one of the preceding aspects.

What is claimed is:

1. A method of fabricating a bottle having a bottle base, the method comprising:

a) providing a mathematically-generated mold for the bottle including the bottle base by i) creating and resolving a hemisphere profile of the bottle base;

ii) while maintaining the hemisphere profile, creating and partially resolving a foot profile of a foot, wherein the foot profile is superimposed atop the hemisphere profile;

iii) for one-half of the foot, establishing a foot width and an angle at which the side of the foot meets the hemisphere profile and removing a portion of the foot to create a valley side of the foot, which meets the hemisphere profile at the established angle;

iv) for the same half of the foot, adding a variable sized fillet radius along a corner edge of the foot and adding a fillet radius between the foot and the hemisphere profile;

v) creating a mirror image for the one-half of the foot to make a complete foot; and vi) copy-rotating the created foot a plurality of times, to make a complete bottle base, the plurality of feet defining a plurality of valleys between the feet, each having a cross section between the feet and each cross section having a center portion which is convex; and b) stretch blow molding a preform using the mold provided in step a) to form the bottle comprising the bottle base;

wherein each foot is resolved from the underlying hemisphere profile of the bottle base, and wherein from about 1% of area to about 20% of area of the hemisphere profile is retained in the complete bottle base.

2. The method according to claim 1, wherein the bottle is a carbonated beverage bottle.

3. The method according to claim 1, wherein the created foot is copy-rotated five (5) times to make a complete bottle base having five feet.

4. The method according to claim 1, wherein the created foot is copy-rotated six (6) times to make a complete bottle base having six feet.

5. The method according to claim 1, wherein from about 2% of area to about 15% of area of the hemisphere profile is retained in the complete bottle base.

6. The method according to claim 1, wherein the ESCR of the bottle is at least about 5% greater than the ESCR of a corresponding bottle made with a conventional base design, wherein the conventional base comprises a plurality of feet defining a plurality of valleys between the feet, each having a cross section between the feet and each cross section having a center portion which is concave.

7. The method according to claim 1, wherein the ESCR of the bottle is at least about 10% greater than the ESCR of a corresponding bottle made with a conventional base design, wherein the conventional base comprises a plurality of feet defining a plurality of valleys between the feet, each having a cross section between the feet and each cross section having a center portion which is concave.

8. A bottle comprising a bottle base wherein the bottle base comprises:

a) a hemisphere profile;

b) at least three (3) feet extending from and superimposed atop the hemisphere profile, each foot having corner edges;

c) a fillet radius along each corner edge of each foot; and d) a fillet radius between each foot and the hemisphere profile, wherein the feet define valleys there between and the center portion of each valley cross section between the feet is convex;

wherein each foot is resolved from the underlying hemisphere structure of the base; and wherein from about 1% of area to about 20% of area of the hemisphere profile is retained in the bottle base, wherein the bottle is fabricated by:

i) providing a mathematically-generated mold for the bottle including the bottle base by A) creating and resolving the hemisphere profile of the bottle base;

B) while maintaining the hemisphere profile, creating and partially resolving a foot profile of a foot, wherein the foot profile is superimposed atop the hemisphere profile;

C) for one-half of the foot, establishing a foot width and an angle at which the side of the foot meets the hemisphere profile and removing a portion of the foot to create a valley side of the foot, which meets the hemisphere profile at the established angle;

D) for the same half of the foot, adding a variable sized fillet radius along a corner edge of the foot and adding a fillet radius between the foot and the hemisphere profile;

E) creating a mirror image for the one-half of the foot to make a complete foot; and F) copy-rotating the created foot a plurality of times, to make a complete bottle base, the plurality of feet defining a plurality of valleys between the feet, each having a cross section between the feet and each cross section having a center portion which is convex; and ii) stretch blow molding a preform using the mold provided in step i) to form the bottle comprising the bottle base.

9. The bottle according to claim 8, wherein the ESCR of the bottle is at least about 5% greater than the ESCR of a corresponding bottle made with a conventional base design, wherein the conventional base comprises a plurality of feet defining a plurality of valleys between the feet, each having a cross section between the feet and each cross section having a center portion which is concave.

10. The bottle according to claim 8, wherein the bottle base comprises five (5) feet extending from and superimposed atop the hemisphere profile.

11. The bottle according to claim 8, wherein the bottle base comprises six (6) feet extending from and superimposed atop the hemisphere profile.

12. The bottle according to claim 8, wherein the bottle is filled with a carbonated beverage.

* * * * *